US006744215B2

(12) United States Patent
Tae et al.

(10) Patent No.: US 6,744,215 B2
(45) Date of Patent: Jun. 1, 2004

(54) CONTROL METHOD AND SYSTEMS FOR IMPROVING LUMINANCE, LUMINOUS EFFICIENCY AND COLOR TEMPERATURE IN AN AC-PDP

(75) Inventors: Heung Sik Tae, Daegu (KR); Sung Il Chien, Daegu (KR); Ki Duck Cho, Kyungsangnam-do (KR)

(73) Assignee: Yeint Co., Ltd., Taegu (KR)

( * ) Notice: Subject to any disclaimer, the term of this patent is extended or adjusted under 35 U.S.C. 154(b) by 0 days.

(21) Appl. No.: 10/343,557

(22) PCT Filed: Jun. 3, 2002

(86) PCT No.: PCT/KR02/01047

§ 371 (c)(1),
(2), (4) Date: Jan. 31, 2003

(87) PCT Pub. No.: WO02/099779

PCT Pub. Date: Dec. 12, 2002

(65) Prior Publication Data

US 2003/0117346 A1 Jun. 26, 2003

(30) Foreign Application Priority Data

Jun. 2, 2001 (KR) ..... 2001/31004

(51) Int. Cl.[7] ..... G09G 3/288; G09G 3/10

(52) U.S. Cl. ..... 315/169.2; 345/60

(58) Field of Search ..... 315/169.2, 169.4, 315/169.3, 169.1; 345/60, 36, 45, 55, 37, 41, 67; 313/582, 584, 586, 587

(56) References Cited

U.S. PATENT DOCUMENTS 6,577,061 B2 * 6/2003 Sano et al. ..... 313/582

FOREIGN PATENT DOCUMENTS

| | | |
|---|---|---|
| JP | 327498 | 11/1999 |
| JP | 267626 | 9/2000 |
| KR | 24668 | 4/2002 |

* cited by examiner

*Primary Examiner*—James Clinger
(74) *Attorney, Agent, or Firm*—Volpe and Koenig, P.C.

(57) ABSTRACT

Control method and system for improving the color temperature of an alternating current (AC) plasma display panel (PDP) are disclosed. The method and apparatus controls the color temperature of an AC PDP, and can maintain high luminance and luminous efficiency even in an XGA class discharge cell as well as a VGA class discharge cell because a discharge space is dispersed from a sustain electrode to the direction of a writing electrode, to thus obtain strong sustain discharge having a large discharge space when a pulse is simultaneously applied to the writing electrode while a sustain pulse waveform is applied during a sustain period of the AC PDP, improves only the bright of a blue cell whose luminance is relatively low regardless of a cell structure because different pulses can be independently applied to the writing electrodes of red, blue, and green cells during the application of the sustain pulse, and controls a color temperature by increasing the luminance of the blue and green cells.

20 Claims, 12 Drawing Sheets

CONTROL METHOD AND SYSTEMS FOR IMPROVING LUMINANCE, LUMINOUS EFFICIENCY AND COLOR TEMPERATURE IN AN AC-PDP

TECHNICAL FIELD

The present invention relates to a control method and system for improving the color temperature of an alternating current (AC) plasma display panel (PDP), and more particularly, to a method and apparatus for controlling the color temperature of an AC PDP, which is capable of maintaining high luminance and luminous efficiency even in an XGA class discharge cell as well as a VGA class discharge cell because a discharge space is dispersed from a sustain electrode to the direction of a writing electrode, to thus obtain strong sustain discharge having a large discharge space when a pulse is simultaneously applied to the writing electrode while a sustain pulse waveform is applied during a sustain period of the AC PDP, of improving only the bright of a blue cell whose luminance is relatively low regardless of a cell structure because different pulses can be independently applied to the writing electrodes of red, blue, and green cells during the application of the sustain pulse, and of controlling a color temperature by increasing the luminance of the blue and green cells. As a result, it is possible to improve the color temperature of a white cell in a state of high luminance.

BACKGROUND ART

FIG. 1A is a perspective view illustrating upper and lower substrates of a common alternating current (AC) surface discharge PDP, which are separated from each other. FIG. 1B is a plane view illustrating the upper and lower substrates of an AC PDP, which are separated from each other. The AC surface discharge PDP includes a front substrate 1 for displaying information and a back substrate 2 having the same width as that of the front substrate 1 and positioned to be parallel to the front substrate 1.

The front substrate 1 includes a plurality of sustain electrode lines X and Y including transparent electrodes 6 and bus electrodes 7 having low resistivity, the sustain electrode lines X and Y for applying a voltage waveform, a dielectric layer 8 formed between sustain electrode lines, the dielectric layer 8 for restricting discharge current, and a protective layer 9 formed on the dielectric layer 8, the protective layer 9 for protecting the sustain electrode lines. The back substrate 2 includes a plurality of partitions 3 forming a discharge space, a plurality of writing electrode lines 4 formed to be perpendicular to the sustain electrode lines between the partitions 3, and a fluorescent film 5 whose discharge spaces are formed to wrap the corresponding writing electrode lines 4 on both partition surfaces and a back substrate, the fluorescent film 5 for receiving vacuum ultraviolet (VUV) generated during discharge and emitting a visible ray.

FIG. 2A is an entire driving waveform chart illustrating waveforms applied to the respective electrodes X, Y and Z during a sub field in a conventional AC PDP. FIG. 2B is an enlarged waveform chart for a sustain pulse.

FIG. 2A illustrates an example of voltage waveforms applied to the sustain electrode lines X and Y formed of the transparent electrodes 6 and the bus electrodes 7 of FIG. 1 in order to display information on the AC PDP and the writing electrode lines 4. A time can be divided into an erase period T1, a write period T2, and a sustain period T3. During the erase period T1, a wall charge that becomes uneven while the AC PDP displays previous information becomes even over an entire panel by alternately applying a low lamp type pulse and a high pulse to the sustain electrode lines X and Y as illustrated in FIG. 2A. During the write period T2, information is written by accumulating a wall charge after writing discharge only on a cell to be displayed by a voltage difference between the sustain electrode line X and the writing electrode line Z. During the sustain period T3, information is displayed by alternately applying a voltage to both sustain electrode lines X and Y and making a visible ray emitted only from the cell, into which information is written during the write period T2.

In a common AC PDP, the waveforms of the X and Y pulses that are both sustain electrode lines are square waves in the sustain period T3. A voltage is not applied to the writing electrode. FIG. 2B illustrates enlarged waveforms applied to the respective electrodes for a time, for which a sustain pulse is applied. T4 denotes a rest period, during which no voltage is applied to all of the electrodes. In T5, the moment a voltage of a square wave is applied to the sustain electrode X and discharge starts, a visible ray is emitted for a short time. After a rest period T6, when a square wave is applied to the sustain electrode Y, discharge occurs and a visible ray is emitted. At this time, no voltage is applied to a writing electrode Z.

Among three primary colors of red R, green G, and blue B used by the common AC PDP in order to express an image, blue is emitted so that the intensity of light is weaker than the intensity of those of green and red due to the characteristic of a discharge gas such as Ne. Accordingly, the AC PDP has a low color temperature. Therefore, in order to use the AC PDP as a commonly used display device, the color temperature must be raised. Accordingly, various methods for raising the color temperature of the AC PDP are provided.

FIGS. 3A to 3C illustrate one of conventional methods for raising the color temperature of the AC PDP by gamma-correcting an analog video signal. Generally, an analog video signal input from the AC PDP is digitalized in 256 luminance steps from 0 to 255 in each color in order to realize gray scales and is expressed by the number of sustain pulses. The analog video signal input to the AC PDP is not corrected in consideration of the characteristic of the AC PDP but is a signal, in which red, green, and blue have the same peak value. In a conventional technology, in order to raise the color temperature of the PDP, as shown in FIGS. 3A to 3C, red (FIG. 3A) and green (FIG. 3B) analog video signals excluding a blue (FIG. 3C) analog video signal having relatively low luminance are inverse gamma corrected so that a peak value of each color is lowered before a digitalizing step and are digitalized. After such a step, the number of sustain pulses having the maximum luminance of red and green is smaller than the number of sustain pulses having the maximum luminance of blue. Accordingly, the color temperature can be raised. For example, if 255 sustain pulses are used for expressing the maximum luminance of blue, the maximum luminance is expressed by about 200 sustain pulses in the case of green and by about 180 sustain pulses in the case of red.

In the conventional method of raising the color temperature, because all of the 255 sustain pulses required for expressing the maximum luminance of green and red are not used, it is disadvantageous to realizing gray scales. As a result, a step phenomenon occurs in red and green in expressing an image that becomes gradually bright or dark.

FIGS. 4A and 4B are views for explaining another method among conventional technologies used for raising the color temperature of the AC PDP. A method of raising the color temperature using uneven partitions is shown. Distance between partitions of a common AC PDP is uniform so that red, green, and blue have discharge spaces of the same width as shown in FIG. 4A. The red, green, and blue cells are combined with each other, to thus form a pixel. When the distance between partitions in a part for displaying a specific color is widened, a discharge space is widened and thus, strong discharge is obtained. Accordingly, it is possible to obtain higher luminance than other colors. A method of raising the color temperature of the AC PDP using the above phenomenon is the method using the uneven partitions shown in FIG. 4B. That is, as illustrated in FIG. 4B, the distance between the partitions of blue having relatively lower luminance than red and green is widened. In order to sustain the size of a pixel to be uniform, the distance between the partitions of red and green is narrowed. Therefore, the discharge space of blue is widened and thus, strong discharge and high luminance can be obtained. The discharge spaces of red and green are narrowed and thus, weak discharge and low luminance are obtained.

The above-mentioned step phenomenon does not occur because the 255 sustain pulses are used for expressing the maximum luminance of each color. During write discharge or sustain discharge, non-uniformity of discharge occurs due to the discharge spaces different from each other according to colors. Accordingly, mis-discharge occurs and a voltage margin for stable driving is reduced. Also, according to the method, the color temperature is increased by changing the structure of a cell. Therefore, once the structure is fixed, a color temperature is fixed though the color temperature is high. Accordingly, it is not possible to realize a function of controlling a color temperature, which high quality video display devices have.

DISCLOSURE OF THE INVENTION

To solve the above problem, it is an object of the present invention to provide a control method and system for selectively increasing the luminance and the luminous efficiency of a blue cell of an alternating current (AC) plasma display panel (PDP) regardless of a symmetrical cell structure or an asymmetrical cell structure, which is capable of increasing the luminance and the luminous efficiency of an XGA class AC PDP as well as a VGA class AC PDP and of selectively increasing the luminance of a blue cell whose luminance is relatively low by applying a pulse to a writing electrode while a sustain pulse is applied to a sustain electrode. Thus, sustain discharge is performed and by enlarging the discharge space of a selected cell, the luminance and the efficiency are increased.

It is another object of the present invention to provide a control method and apparatus for raising the color temperature of an AC PDP, which is capable of controlling the color temperature in a state where the luminance is not lowered, to thus raise the color temperature, by simultaneously applying pulses having appropriate width and height to writing electrodes of green and blue cells that can contribute to raising the color temperature through various methods while the sustain pulse is applied and the sustain discharge is performed.

To achieve the above objects, in one aspect of the present invention, there is provided a control method for enhancing a color temperature of an alternating current type plasma display panel which includes a plurality of pixels for implementing a color image, a plurality of discharge cells having at least one color in the respective pixel, and a maintenance time period for driving, and displays image data by inducing discharge of the plurality of cells through a plurality of sustain electrodes and writing electrodes, the method comprising the steps of a) inducing a sustain discharge between the sustain electrodes of the respective cells by applying a sustain pulse according to the image data and b) applying a control pulse having a predetermined voltage to the writing electrode of at least one discharge cell of the plurality of discharge cells with different colors so as to independently control a luminance of the respective discharge cells with different colors for the sustain pulse is continuously applied.

Preferably, the colors are red (R), green (G), and blue (B), and the step b) includes the sub-step of applying the control pulse having the predetermined voltage to a writing electrode for the blue (B).

According to the features of the present invention, the step b) includes the sub-step of applying the control pulse having the predetermined voltage to a writing electrode for the green (G) independently with the control pulse applied to the writing electrode for the blue (B).

Preferably, the step b) includes the sub-step of applying the control pulse having the predetermined voltage to a writing electrode for the red (R) independently with the control pulses applied to the writing electrodes for the blue (B) and green (G).

Preferably, the control pulse is applied simultaneously with when the sustain pulse is applied.

Preferably, the appliance of the control pulse is delayed as much as a time interval between the sustain pulse is applied and a predetermined time.

Preferably, the control pulse is comprised of at least one pulse array when the sustain pulse is continued.

Preferably, the step b) adjusts the voltage of the control pulses applied to the respective writing electrodes of the discharge cells with different colors according to the color temperature required to the plasma display panel.

Preferably, the step b) adjusts the time-axial position of the control pulses applied to the respective writing electrodes of the discharge cells with different colors according to the color temperature required to the plasma display panel.

Preferably, the step b) adjusts the voltage of the control pulses applied to the respective writing electrodes of the discharge cells with different colors according to the color temperature required to the plasma display panel.

In another aspect of the present invention, there is provided a controlling apparatus for enhancing color temperature of an alternating current type plasma display panel, which includes a plurality of pixels for implementing a color image, a plurality of discharge cells having at least one color in the respective pixel, and a maintenance time period for driving, and displays image data by inducing discharge of the plurality of cells through a plurality of sustain electrodes and writing electrodes, the apparatus comprising a sustain pulse circuit for inducing a sustain discharge between the sustain electrodes of the respective cells by applying a sustain pulse according to the image data, and a color temperature controlling circuit for applying a control pulse having a predetermined voltage to the writing electrode of at least one discharge cell of the plurality of discharge cells with different colors so as to independently control a luminance of the respective discharge cells with different colors for the sustain pulse is continuously applied.

BRIEF DESCRIPTION OF THE DRAWINGS

The above objects and advantages of the present invention will become more apparent by describing in detail preferred embodiments thereof with reference to the attached drawings in which.

BEST MODE FOR CARRYING OUT THE INVENTION

Figure 1A:
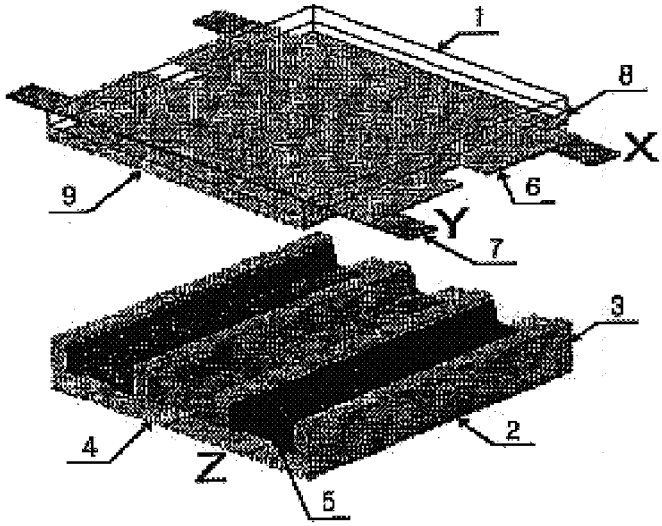
FIG. 1A (RELATED ART)
FIG. 1A is a perspective view illustrating a structure of a common conventional alternating current (AC) surface discharge plasma display panel (PDP)
Figure 1B:
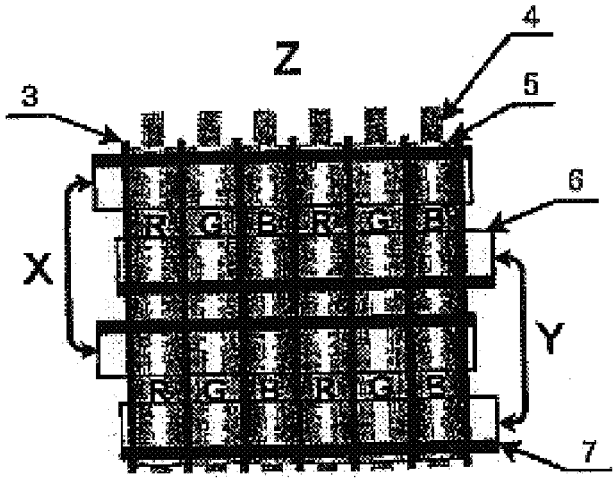
FIG. 1B (RELATED ART)
FIG. 1B is a plane view illustrating the structure of the common conventional AC surface discharge PDP.
Figure 2A:
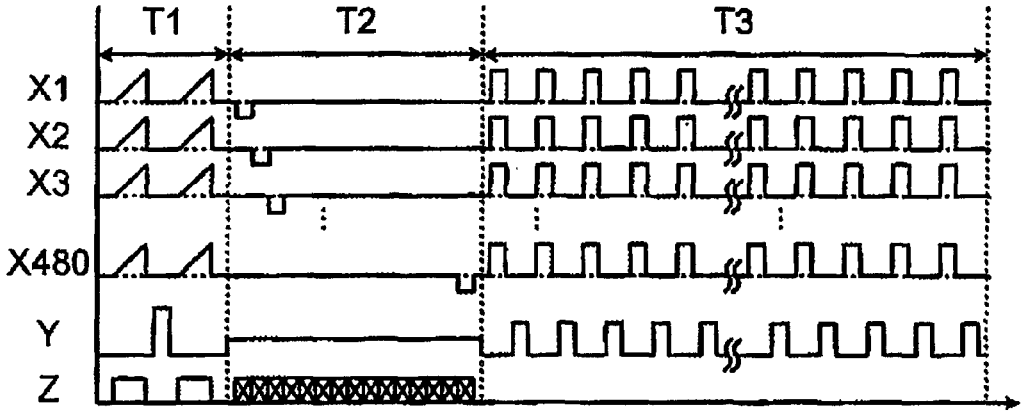
FIG. 2A (RELATED ART)
FIG. 2A illustrates an example of driving waveforms applied to the respective electrodes when the common conventional AC PDP is driven.
Figure 2B:
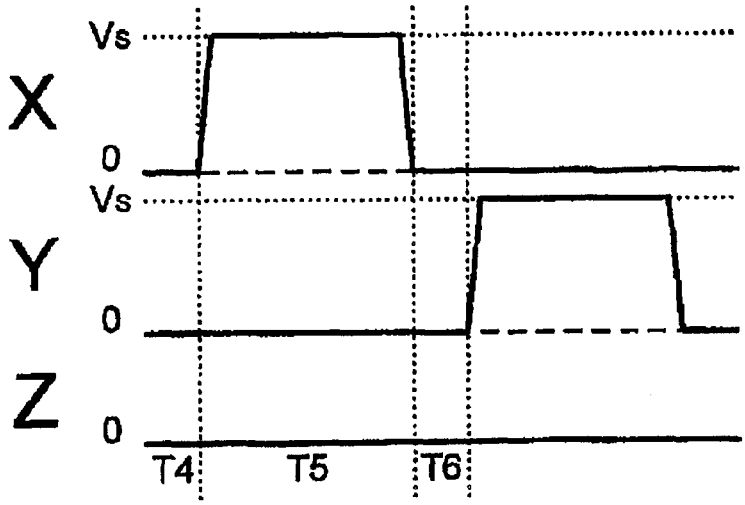
FIG. 2B (RELATED ART)
FIG. 2B illustrates enlarged waveforms for a sustain pulse in the driving waveforms applied to the respective electrodes while the common conventional AC PDP is driven.
Figure 3A:
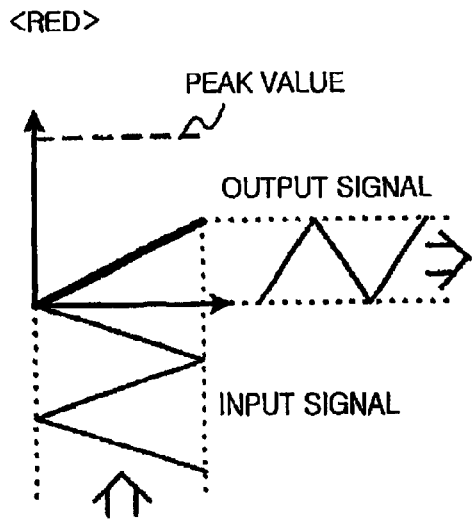
FIG. 3A (RELATED ART)
FIG. 3A illustrates a correction method for red in a method of raising a color temperature through gamma correction of a conventional analog video signal.
Figure 3B:
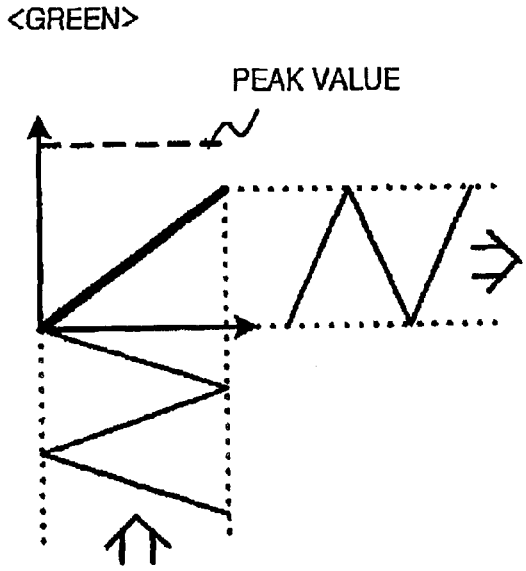
FIG. 3B (RELATED ART)
FIG. 3B illustrates a correction method for green in the method of raising the color temperature through the gamma correction of the conventional analog video signal.
Figure 3C:
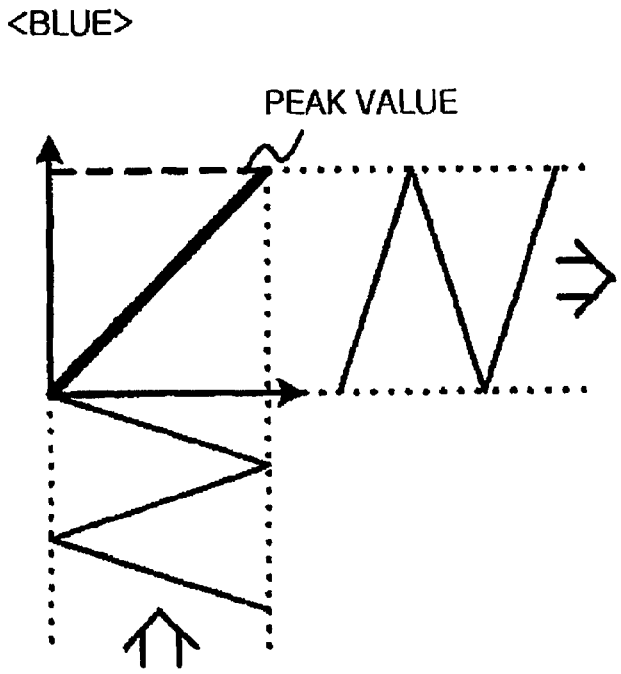
FIG. 3C (RELATED ART)
FIG. 3C illustrates a correction method for blue in the method of raising the color temperature through the gamma correction of the conventional analog video signal.
Figure 4A:
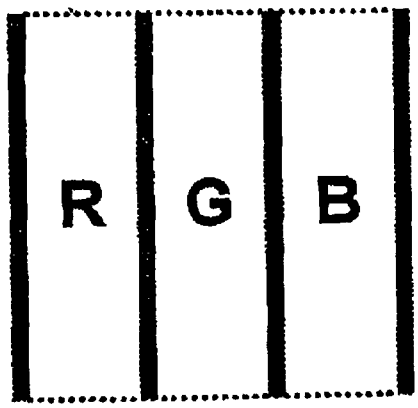
FIG. 4A (RELATED ART)
FIG. 4A is a model picture illustrating a conventional cell structure using an even partition.
Figure 4B:
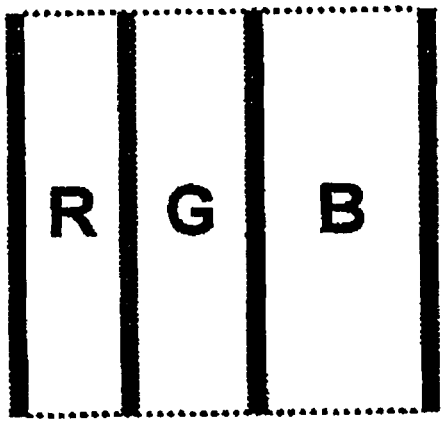
FIG. 4B (RELATED ART)
FIG. 4B is a model picture illustrating a conventional method of raising a color temperature through an uneven partition.

Hereinafter, the present invention will be described in detail by describing preferred embodiments of the invention with reference to the accompanying drawings. The same reference numerals in different drawings represent the same element.

Figure 11:
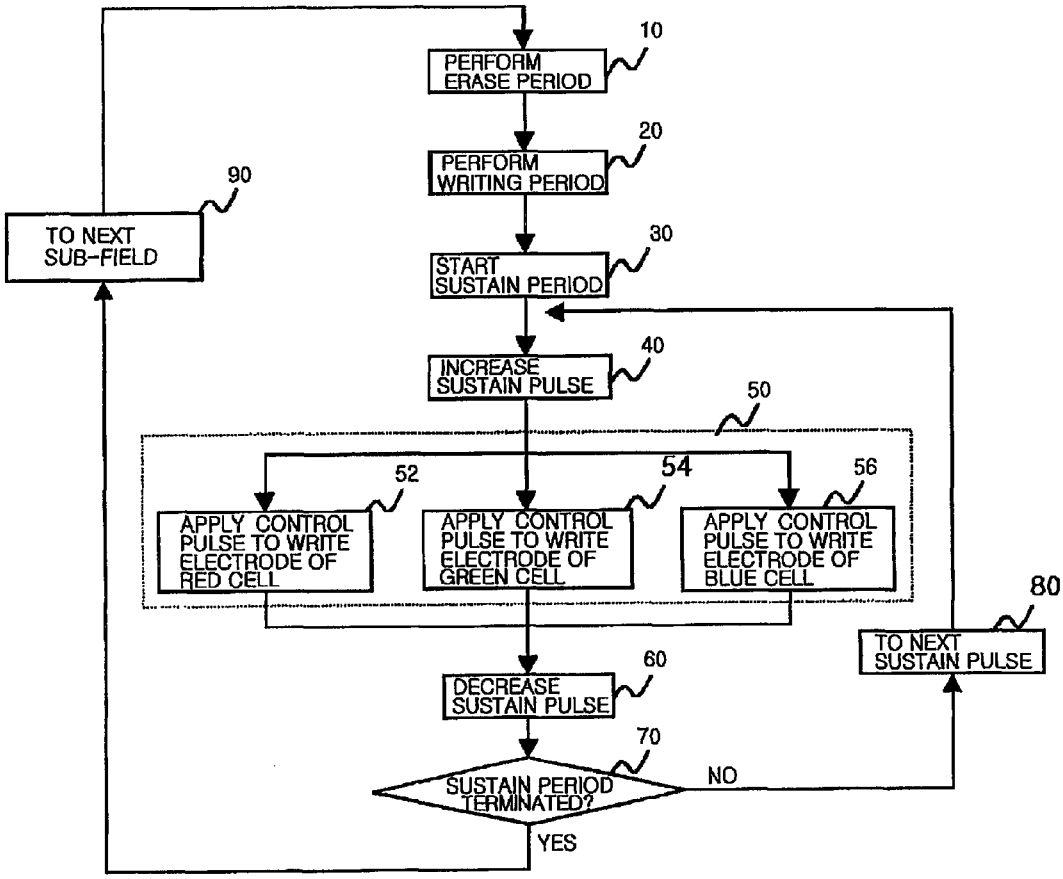
FIG. 11 illustrates a preferred embodiment of a control method for raising the color temperature of the AC PDP according to the present invention.

FIG. 11 illustrates a preferred embodiment of a control method for raising the color temperature of an alternating current (AC) plasma display panel (PDP) according to the present invention. As illustrated in FIG. 11, the method according to the present invention includes the step (10) of proceeding a driving procedure of an erase period, the step (20) of proceeding a driving procedure of a write period, the step (30) of starting a sustain period, sustain pulse applying steps (40 and 60) of raising and falling a sustain pulse accordingly and generating sustain discharge for an appropriate time, and a color temperature control step (50) of independently applying a control pulse having a predetermined voltage to the blue discharge cell or the writing electrode of each discharge cell in order to selectively control the luminance of the blue discharge cell or to independently control the luminance of the respective discharge cells having different colors within a period where the sustain pulse is continuously applied.

More than one color generally refer to red (R), green (G), and blue (B). The color temperature control step 50 may include the step (56) of applying a control pulse having a predetermined voltage to the writing electrode of blue (B). The color temperature control step (50) may further include the step (54) of applying a control pulse having a predetermined voltage to the writing electrode of green (G) to be separate from a control pulse applied to the writing electrode of blue (B). The color temperature control step (50) may further include the step (52) of applying a control pulse having a predetermined voltage to the writing electrode of red (R) to be separate from a control pulse applied to the writing electrodes of blue (B) and green (G). To a writing electrode connected to a cell of which color a pulse is applied in order to control a color temperature can variously change. This is because the relative rate of luminance is important. The present invention is a technology of raising a color temperature by selectively increasing the luminance of a blue (B) cell by applying a control pulse having a predetermined voltage to a writing electrode or by independently controlling the luminance of green (G) and red (R) cells in a state where the luminance of the blue (B) cell is increased.

Figure 5:
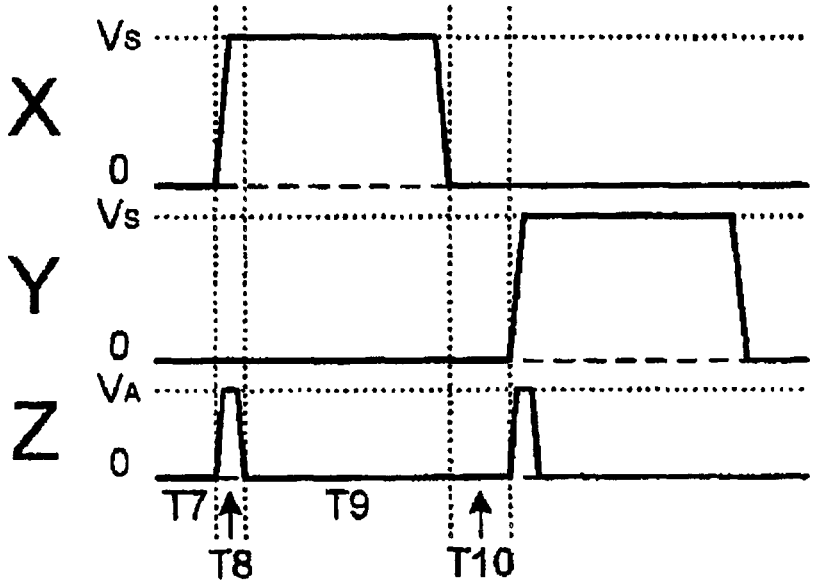
FIG. 5 is a waveform chart illustrating a method of applying a pulse to a writing electrode simultaneously to a sustain pulse in order to increase luminance during a sustain period in an AC PDP according to the present invention.

FIG. 5 is a waveform chart illustrating an example of waveforms applied to the respective electrodes in order to increase the luminance using a writing electrode (Z) during the sustain period of the AC PDP in a preferred embodiment of a control method for increasing the luminance or raising the color temperature of the blue cell of the AC PDP according to the present invention.

Referring to an example of FIG. 5, if pulses having predetermined voltage VA, width, and rising slope are applied to a writing electrode Z in an appropriate position when a sustain pulse having a predetermined voltage Vs is applied to sustain electrodes X and Y during a sustain period and thus, sustain discharge occurs, sustain discharge narrowly generated only under the sustain electrode can be induced to large sustain discharge having a large volume, which uses the entire space inside a cell. This is because an electric field is applied between the sustain electrode and the writing electrode in addition to the electric field applied to between two sustain electrodes (X, Y). Because it is possible to draw electrons inside plasma, which are generated by the electric field during the sustain discharge, to the writing electrode, it is possible to make the sustain discharge be widely generated inside a discharge cell. Accordingly, it is possible to increase the luminance. A degree, to which the luminance and the efficiency of the discharge cell increases, can vary according to the voltage, the width, the rising slope, and the application position of the control pulse applied to the writing electrode. The present invention is derived from observing the effect of the increment of the discharge space due to the pulse induced to the writing electrode as above. By utilizing the writing electrode Z during the sustain period as described above, the respective luminance of the discharge cells with different colors can be independently controlled needless to differ the size of the discharge cell by colors or without data loss of the gray scale realization, and more especially, the luminance of the blue discharge cell which is a reason of fatal failure for realizing the high density image of the plasma display can be selectively increased.

Figure 12A:
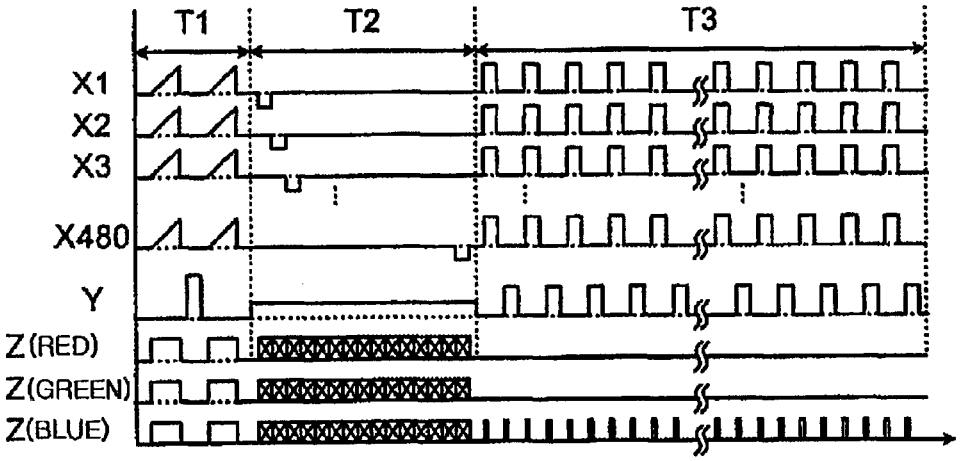
FIG. 12A illustrates an example of a driving waveform chart where different waveforms are applied to a writing electrode only in a blue cell in order to raise the color temperature of the AC PDP according to the present invention.
Figure 12B:
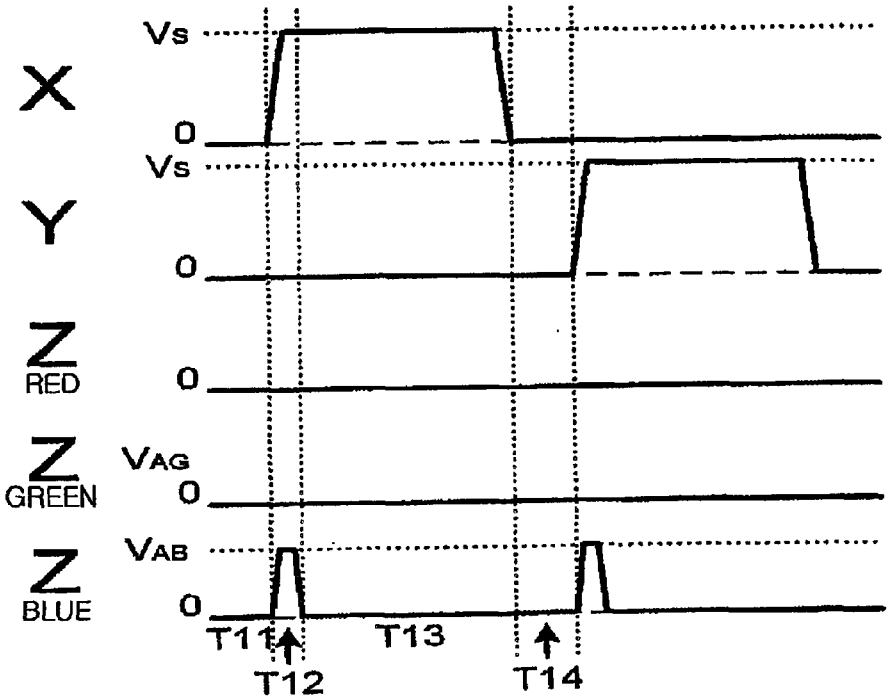
FIG. 12B is an enlarged waveform chart for a sustain pulse in the driving waveform chart where different waveforms are applied to a writing electrode only in a blue cell in order to raise the color temperature of the AC PDP according to the present invention.

FIG. 12A shows an example of whole driving waveforms as control pulses which are applied to the writing electrode Z of the blue discharge cell by expanding the luminance enhancing method, in order to enhance only the luminance of the blue discharge cell, during the sustain period in the alternating current type PDP shown in FIG. 5. FIG. 12B is an enlarge waveform chart with respect to one of the sustain pulses shown in FIG. 12A.

In FIG. 12A, the waveform, which is applied to the sustain electrode and the writing electrode during the erase period TI and the write period T2, is identical to the driving waveform of the conventional alternating current type PDP. During the sustain period T3 when the present invention is applied, a pulse having a predetermined voltage and width is applied to only the blue writing electrode Z when the sustain waveform is applied to two sustain electrodes X and Y. The pulse applied only to the blue writing electrode Z, as described above, induces a discharge of large volume so as to selectively enhance the luminance of the blue discharge cell.

FIG. 12B is an enlarged view of a waveform being applied to the respective electrodes for the time when one sustain pulse is applied during the sustain period T3 shown in FIG. 12A. The reference character T11 indicates a suspension period when voltage is not applied to all electrodes. In T12, appliance of a pulse having a voltage $V_{AB}$ to the writing electrode Z of the blue discharge cell induces discharge with large volume when a visible radiation is emitted for a short time while the discharge is started by applying a voltage of rectangular waveform to one sustain electrode X.

Here, to the writing electrodes of the red and green discharge cells, voltage is not applied. The volume of the discharge can be adjusted by adjusting the magnitude of the voltage $V_{AB}$ applied to the blue discharge cell or the rising slope. After the period T13 when the sustain voltage is continuously applied to the sustain electrode X and the rest period T14, the procedure as described above is repeated to the opposite sustain electrode Y.

Figure 6A:
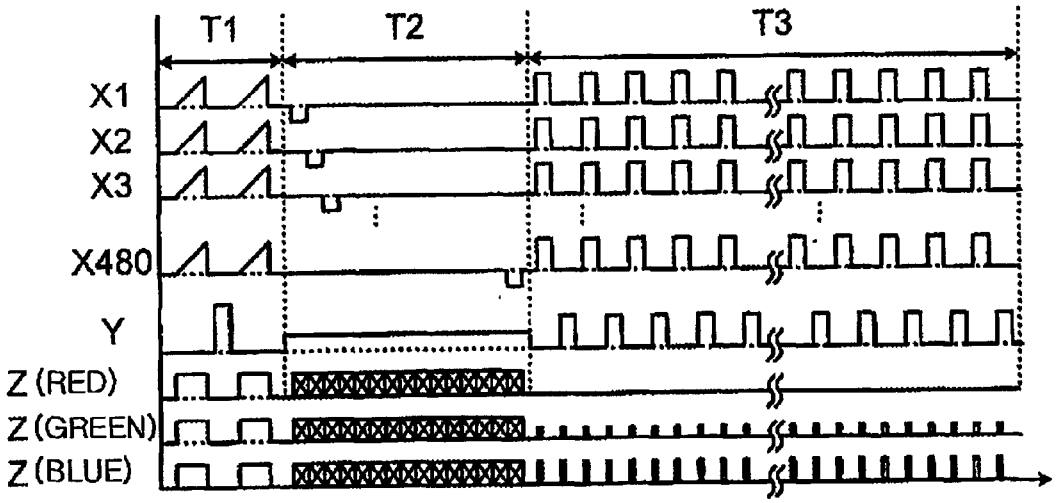
FIG. 6A illustrates an example of a driving graph where different waveforms are applied to a writing electrode in each color in order to raise the color temperature of the AC PDP according to the present invention.
Figure 6B:
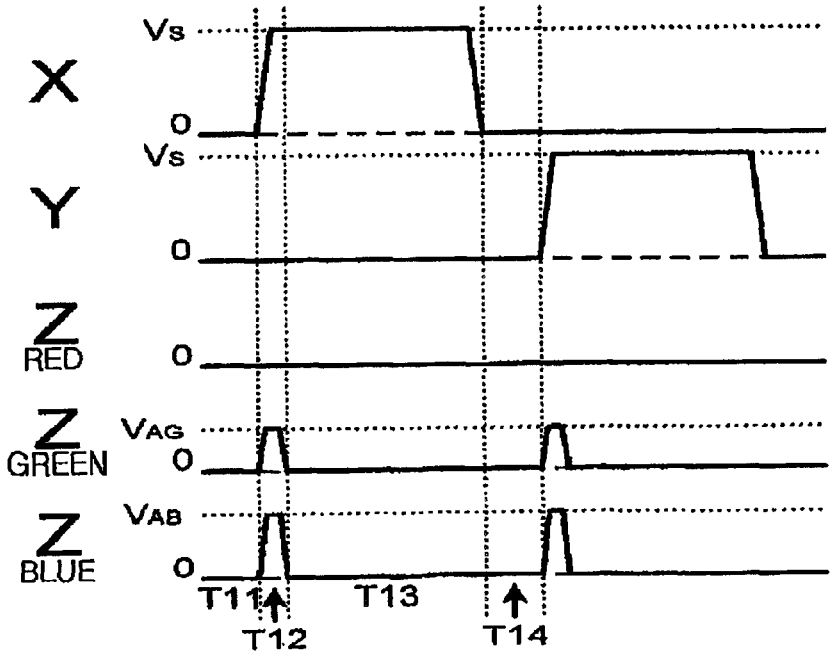
FIG. 6B is an enlarged waveform chart for a sustain pulse in a driving waveform chart where different waveforms are applied to a writing electrode in each color in order to raise the color temperature of the AC PDP according to the present invention.

FIG. 6A shows an example of whole driving waveforms as control pulses which are applied to the writing electrodes Z of the discharge cells of the respective colors R, G, and B by expanding the luminance enhancing method, in order to enhance the luminance, during the sustain period in the alternating current type PDP shown in FIG. 5. FIG. 6B is an enlarge waveform chart with respect to one of the sustain pulses shown in FIG. 6A.

In FIG. 6A, the waveform, which is applied to the sustain electrode and the writing electrode during the erase period T1 and the write period T2, is identical to the driving waveform of the conventional alternating current type PDP. During the sustain period T3 when the present invention is applied, a pulse having a predetermined voltage and width is simultaneously applied to the writing electrodes Z of the blue and the green discharge cells when the sustain waveform is applied to two sustain electrodes X and Y. The pulse applied to the blue and green writing electrodes Z, as described above, induces a discharge of large volume so as to selectively enhance the luminance of the blue nd green discharge cells.

FIG. 12B is an enlarged view of a waveform being applied to the respective electrodes for the time when one sustain pulse is applied during the sustain period T3 shown in FIG. 12A. The reference character T11 indicates a suspension period when voltage is not applied to all electrodes. In T12, appliance of a pulse having a voltage $V_{AG}$ or $V_{AB}$ to one or both of the writing electrode Z of the blue discharge cell and green discharge cell induces discharge with large volume when a visible radiation is emitted for a short time while the discharge is started by applying a voltage of rectangular waveform to one sustain electrode X.

Here, since the red writing electrode has a relative high rightness, the voltage is not applied to the red writing electrode but to the green and blue writing electrodes. To the blue writing electrode, a pulse having a relative high voltage than the green writing electrode can be applied. At that time, by adjusting the magnitudes of the voltage $V_{AG}$ or $V_{AB}$ applied to the green writing electrode or the blue writing electrode, the volume of the discharge can be adjusted. In order to display white color, by exchanging the ratio of the green color for the ratio of the blue color, the color temperature can be adjusted. After the period T13 when the sustain voltage is continuously applied to the sustain electrode X and the rest period T14, the procedure as described above is repeated to the opposite sustain electrode Y. Moreover, if necessary, in order to use the achievement effect of the high luminance through the increase of the discharge space as described above for enhancing the discharging effect of all discharge cells, pulse can be applied to all writing electrodes of the discharge cells of red, green, and blue, while the magnitude of the pulse is different to each other.

Figure 7:
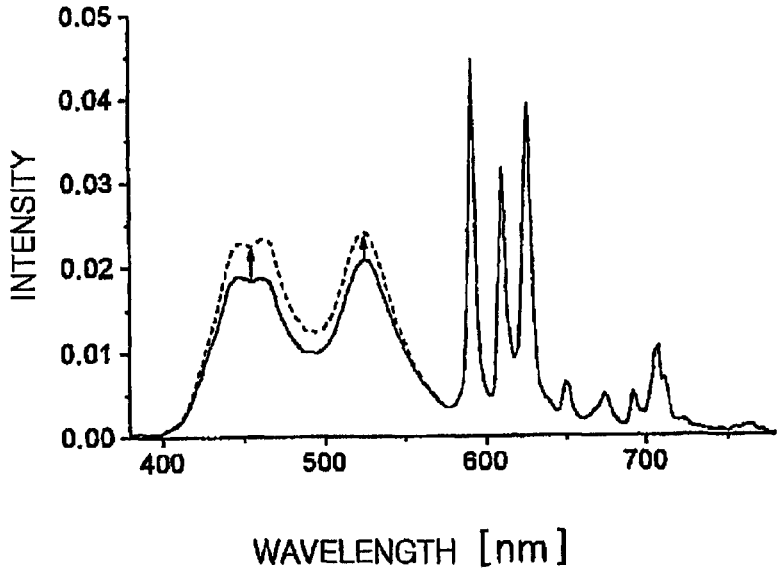
FIG. 7 is a view illustrating that the intensity of the wavelengths of blue and green regions increases in a spectrum illustrating a visible ray emitted (radiated) from the AC PDP according to the present invention in each wavelength.

Meanwhile, FIG. 7 is a view showing the intensities of the visible radiation emitted from the AC PDP by wavelength measured by the experiment in the cases that a conventional driving waveform is applied to the respective electrodes and the driving waveform of the present invention is applied to, shown in FIGS. 6A and 6B. As shown in the drawings, the visible radiations (rays) emitted from the AC PDP are divided into a blue visible radiation of wavelength 400–500 nm (nanometers), a green visible radiation of wavelength 500–580 nm (nanometers), and a red visible radiation of wavelength 580–640 nm (nanometers).

The solid line in the same drawings represents the case that a conventional driving waveform is applied to the AC PDP, and the dotted line represents the case that the driving waveform of the present invention is applied. As shown in drawings, when the driving waveform of the present invention is applied to, it can be seen that the intensities of the wavelengths corresponding to the blue and green colors are increased. The intensities of the blue and green colors can be easily and independently adjusted by changing the voltages $V_{AG}$ and $V_{AB}$ which are applied to the writing electrodes shown in FIG. 6B as described above.

Figure 8:
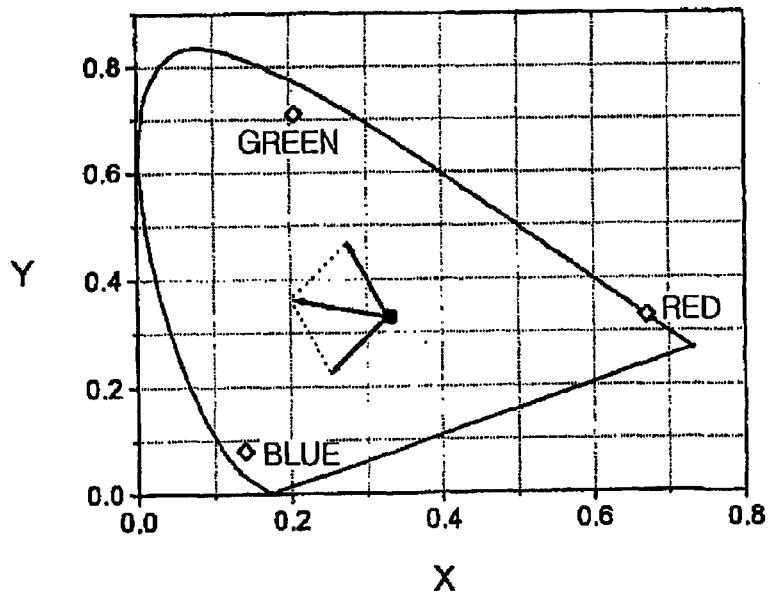
FIG. 8 is a view illustrating that white color coordinates emitted (radiated) from the AC PDP according to the present invention moves in a direction where a color temperature rises.

Moreover, FIG. 8 is a view showing the variation of coordinate of the white color emitted from the AC PDP in the cases that a conventional driving waveform is applied to the respective electrodes and the driving waveform of the present invention is applied to. By comparing the two cases, it can be understood that the color coordinate moves in left direction like as arrows shown in FIG. 8 according to a degree of the increase of the luminance of the green and blue colors. The direction represents the direction that the color temperature increases.

Figure 9A:
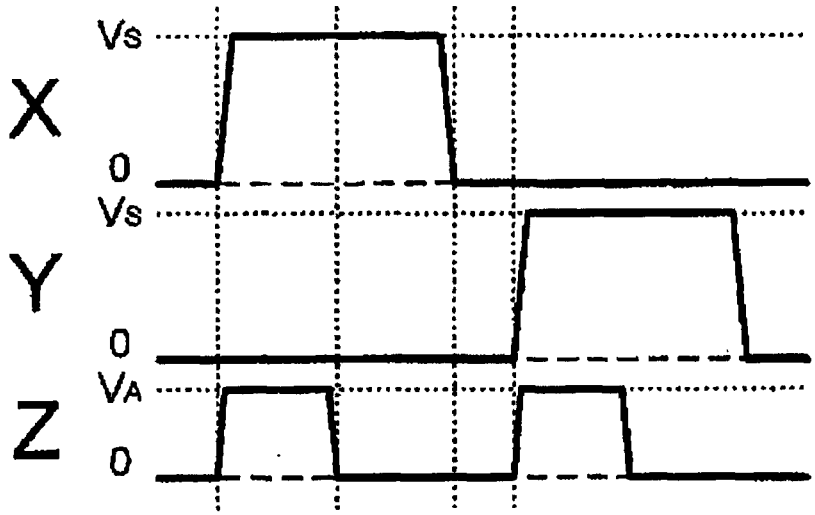
FIGS. 9A to 9C are waveform charts illustrating waveforms that can be variously applied to a writing electrode according to a degree, to which luminance of a color rises and which is required by the AC PDP according to the present invention.
Figure 9B:
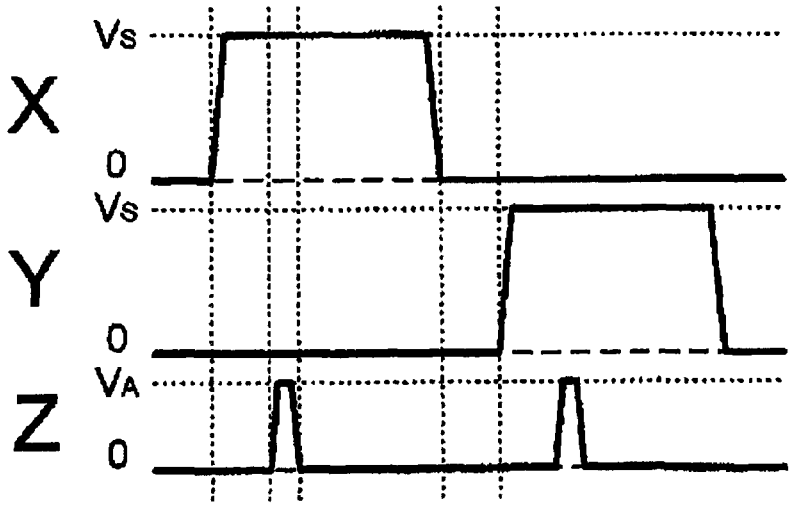
Figure 9C:
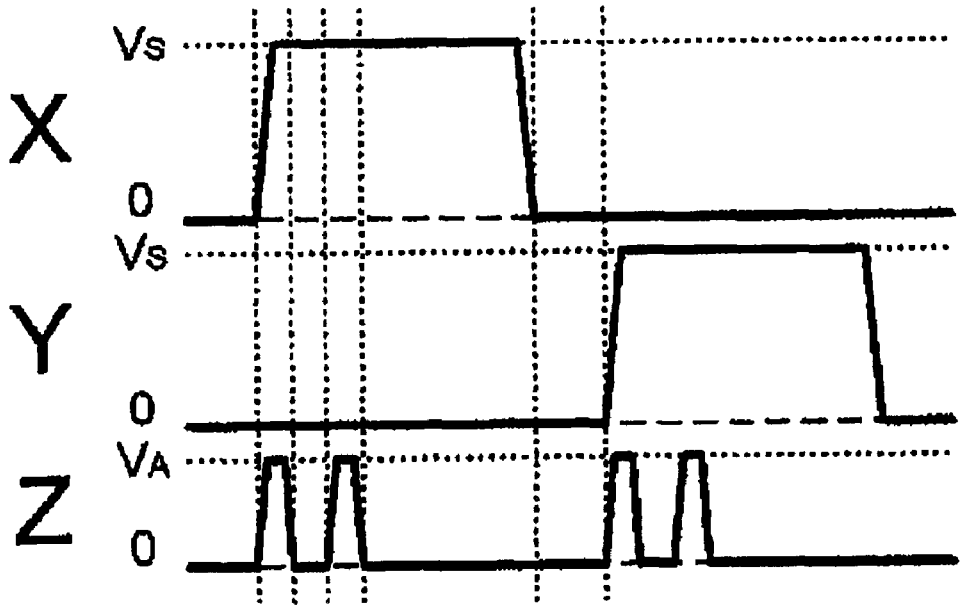

Meanwhile, FIGS. 9A through 9C illustrate embodiments, derived from same spirit of the above embodiments of the present invention, of the various pulses which are capable of being applied to only the writing electrode of the blue discharge cell or both of the writing electrodes of the green and blue discharge cells in the method for applying respective electrodes according to the present invention, and depict only shapes of the pulses without distinguishing the voltage level to be applied to the writing electrodes of the respective colors R, G, B. Though the case that the sustain electrode and the writing electrode are applied with the pulses as shown in the same drawings, the color temperature of the PDP can be enhanced like the above embodiments. At that time, by adjusting the voltage of the pulse to be applied to the writing electrode, the color temperature can be also adjusted. The spirit of the present invention is to selectively enhance the luminance of the blue by applying the control pulse to the writing electrode of the blue discharge cell during the apply of the sustain pulse, by utilizing the point that strong sustain discharge having a large discharge space by using the writing electrode during the sustain period, or to control the color temperature of the various pulses by relatively increasing the luminance of the blue and green by applying different pulses to the respective writing electrodes of the red, blue, and green cells, and it is possible to modify various arrays and formations of pulses for the purpose of achieving the same. Since the modification is achieved from the spirit of the present invention, it is obvious that the modification is within the scope of the present invention.

FIG. 9A shows a case that a pulse is applied to a writing electrode together the sustain pulse. As shown, the pulse can be applied to writing electrode by a predetermined time interval later than the applying timing of the sustain pulse as shown in FIG. 9B, and the pulse can be applied by being divided into several pulses as shown in FIG. 9C. Moreover, in the respective cases, pulses of various magnitudes can be applied. Since the voltage of the pulse should not be a uniform voltage when the pulse is continued, a variety of modification of the respective unit pulses can be made.

Moreover, there are various methods for independently control the luminance of discharge cells having different colors each other. The voltages of the control pulses to be applied to the respective writing electrodes of the above blue discharge cell or other discharge cell of different color can be adjusted to be different, and the positions on the time axis of the control pulses to be applied to the writing electrode of the blue discharge cell or the other discharge cell of different color can be adjusted to be different. Moreover, numbers of the control pulses to be applied to the writing electrode of the above blue discharge cell or the other discharge cell of different color can be adjusted to be different. This is because that a variety of modification can be made within the scope of the present invention, since the core spirit of the present invention is to use the writing electrode in order to causing the relative luminance according to the same image date between the discharge cells of different colors.

Figure 10:
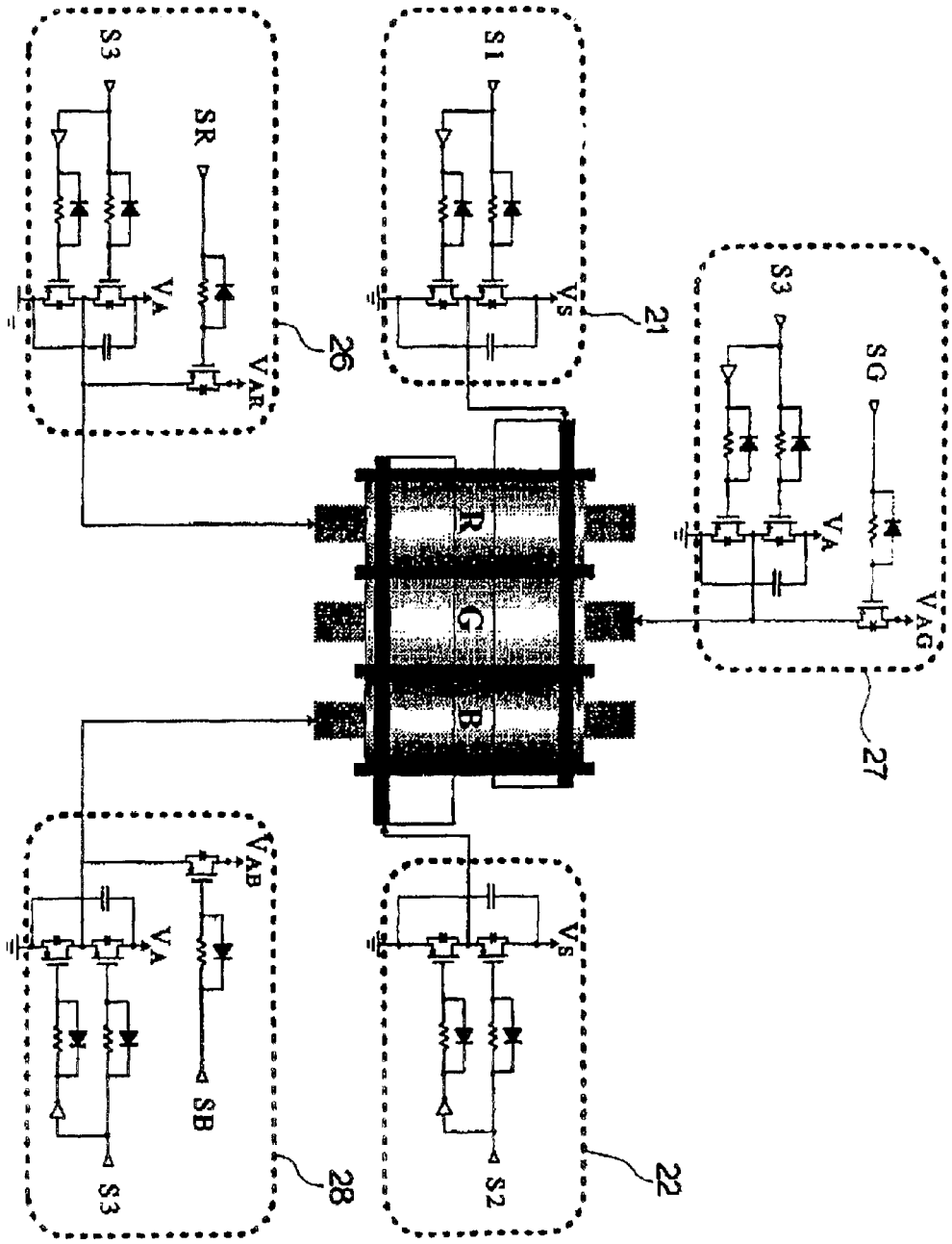
FIG. 10 is a circuit diagram of a driving circuit for generating waveforms applied to the respective electrodes in order to raise the color temperature of the AC PDP according to the present invention.

Further, FIG. 10 is a circuit diagram for illustrating a preferred embodiment of a circuit generating a driving waveform to be applied to the respective electrodes of the AC type PDP according to the present invention. The circuit includes a first and second sustain driving circuits 21 and 22 for applying the driving pulses to the respective sustain electrodes X and Y, and a first, a second, and a third address driving circuits 26, 27, and 28 for applying the driving pulses to the writing electrodes Z of the respective colors G, G, and B.

In the same drawing, a sustain pulse circuit comprised of the first and second driving circuits 21 and 22 can be constituted similar to a sustain pulse circuit used in the conventional AC type PDP. The respective address driving circuits 26, 27, and 28 can be constituted with a portion S3 identical to the conventional circuit used in the address driving circuit of the conventional AC type PDP, and a color temperature controlling circuits SR, SG, and SB newly added to generate a control pulse to the writing electrodes of the red, green, and blue R, G, and B within the sustain period when the sustain pulse is applied in accordance with the present invention. In other words, the SR, SG, and SB circuits constituting the color temperature controlling circuit in the respective address driving circuits 26, 27, and 28 as shown in FIG. 10, as described above, enhance the color temperature of the AC type PDP by generating control pulses having different predetermined voltages when the sustain pulses are applied to the sustain electrodes X and Y. Since the operation and driving waveform of the respective circuits are same as described above, the detailed description of this embodiment will be omitted.

Industrial Applicability

According to the present invention, as described above, the present invention uses that the luminance can be enhanced by increasing the discharge space of the selected cell by applying a pulse to a writing electrode when the sustain discharge is performed by which the sustain pulse is applied to the sustain electrode. According to the present invention, the color temperature can be controlled by applying pulses having a appreciate width and height in various way only to the blue cell or to both of green and blue cells. Through these facts, the present invention provides an alternating current type plasma display panel whose color temperature of white color can be enhanced so that can achieve the high definition plasma display panel.

What is claimed is:

1. A control method for enhancing color temperature of an alternating current type plasma display panel which includes a plurality of pixels for implementing a color image, a plurality of discharge cells having at least one color in the respective pixel, and a maintenance time period for driving, and displays image data by inducing discharge of the plurality of cells through a plurality of sustain electrodes and writing electrodes, the method comprising the steps of:

a) inducing a sustain discharge between the sustain electrodes of the respective cells by applying a sustain pulse according to the image data; and b) applying a control pulse having a predetermined voltage to the writing electrode of at least one discharge cell of the plurality of discharge cells with different colors so as to independently control a luminance of the respective discharge cells with different colors for the sustain pulse is continuously applied.

2. The method of claim 1, wherein the color comprises red (R), green (G), and blue (B), and the step b) comprises the sub-step of applying the control pulse having the predetermined voltage to a writing electrode for the blue (B).

3. The method of claim 2, wherein the step b) comprises the sub-step of applying the control pulse having the predetermined voltage to a writing electrode for the green (G) independently with the control pulse applied to the writing electrode for the blue (B).

4. The method of claim 3, wherein the step b) comprises the sub-step of applying the control pulse having the predetermined voltage to a writing electrode for the red (R) independently with the control pulses applied to the writing electrodes for the blue (B) and green (G).

5. The method of any one of claims 1 through 4, wherein the control pulse is applied simultaneously with when the sustain pulse is applied.

6. The method of any one of claims 1 through 4, wherein the appliance of the control pulse is delayed as much as a time interval between the sustain pulse is applied and a predetermined time.

7. The method of any one of claims 1 through 4, wherein the control pulse is comprised of at least one pulse array when the sustain pulse is continued.

8. The method of any one of claims 1 through 4, wherein the step b) adjusts the voltage of the control pulses applied to the respective writing electrodes of the discharge cells with different colors according to the color temperature required to the plasma display panel.

9. The method of any one of claims 1 through 4, wherein step b) adjusts the time-axial position of the control pulses applied to the respective writing electrodes of the discharge cells with different colors according to the color temperature required to the plasma display panel.

10. The method of any one of claims 1 through 4, wherein the step b) adjusts the voltage of the control pulses applied to the respective writing electrodes of the discharge cells with different colors according to the color temperature required to the plasma display panel.

11. A controlling apparatus for enhancing color temperature of an alternating current type plasma display panel which includes a plurality of pixels for implementing a color image, a plurality of discharge cells having at least one color in the respective pixel, and a maintenance time period for driving, and displays image data by inducing discharge of the plurality of cells through a plurality of sustain electrodes and writing electrodes, the apparatus comprising:

a sustain pulse circuit for inducing a sustain discharge between the sustain electrodes of the respective cells by applying a sustain pulse according to the image data; and a color temperature controlling circuit for applying a control pulse having a predetermined voltage to the writing electrode of at least one discharge cell of the plurality of discharge cells with different colors so as to independently control a luminance of the respective discharge cells with different colors for the sustain pulse is continuously applied.

12. The controlling apparatus of claim 11, wherein the color comprises red (R), green (G), and blue (B), and the color temperature controlling circuit comprises a circuit for applying the control pulse having the predetermined voltage to a writing electrode for the blue (B).

13. The controlling apparatus of claim 12, wherein the color temperature controlling circuit comprises a circuit for applying the control pulse having the predetermined voltage to a writing electrode for the green (G) independently with the control pulse applied to the writing electrode for the blue (B).

14. The controlling apparatus of claim 13, wherein the color temperature controlling circuit comprises a circuit for applying the control pulse having the predetermined voltage to a writing electrode for the red (R) independently with the control pulses applied to the writing electrodes for the blue (B) and green (G).

15. The controlling apparatus of any one of claims 11 through 14, wherein the control pulse is applied simultaneously with when the sustain pulse is applied.

16. The controlling apparatus of any one of claims 11 through 14, wherein the appliance of the control pulse is delayed as much as a time interval between the sustain pulse is applied and a predetermined time.

17. The controlling apparatus of any one of claims 11 through 14, wherein the control pulse is comprised of at least one pulse array when the sustain pulse is continued.

18. The controlling apparatus of any one of claims 11 through 14, wherein the color temperature controlling circuit adjusts the voltage of the control pulses applied to the respective writing electrodes of the discharge cells with different colors according to the color temperature required to the plasma display panel.

19. The controlling apparatus of any one of claims 11 through 14, wherein the color temperature controlling circuit adjusts the time-axial position of the control pulses applied to the respective writing electrodes of the discharge cells with different colors according to the color temperature required to the plasma display panel.

20. The controlling apparatus of any one of claims 11 through 14, wherein the color temperature controlling circuit adjusts the voltage of the control pulses applied to the respective writing electrodes of the discharge cells with different colors according to the color temperature required to the plasma display panel.

* * * * *